US008166682B2

(12) United States Patent
Pan

(10) Patent No.: US 8,166,682 B2
(45) Date of Patent: May 1, 2012

(54) SOLEPLATE UNIT OF ELECTRIC IRON

(75) Inventor: Chien-Chih Pan, Tainan (TW)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 230 days.

(21) Appl. No.: 12/628,459

(22) Filed: Dec. 1, 2009

(65) Prior Publication Data

US 2010/0132230 A1 Jun. 3, 2010

(30) Foreign Application Priority Data

Dec. 1, 2008 (CN) ..... 2008 2 0181301 U

(51) Int. Cl.
*D06F 75/38* (2006.01)
*D06F 79/00* (2006.01)

(52) U.S. Cl. ..... 38/93

(58) Field of Classification Search ..... 38/74, 75, 38/77.82, 80, 81, 88, 93, 94, 97; 219/245
See application file for complete search history.

(56) References Cited

U.S. PATENT DOCUMENTS

| | | | | | |
|---|---|---|---|---|---|
| 592,918 | A * | 11/1897 | Rice | 38/94 |
| 1,972,035 | A * | 8/1934 | Schwartz | 38/93 |
| 2,065,366 | A * | 12/1936 | Eichorn | 38/93 |
| 2,792,977 | A * | 5/1957 | Klein | 223/36 |
| 3,603,012 | A * | 9/1971 | Haynes | 38/97 |
| 5,721,418 | A * | 2/1998 | Hazan et al. | 219/257 |
| 7,188,442 | B2 * | 3/2007 | Fernandez | 38/81 |
| 2009/0223097 | A1 * | 9/2009 | Lee | 38/93 |

* cited by examiner

*Primary Examiner* — Ismael Izaguirre
(74) *Attorney, Agent, or Firm* — Rabin & Berdo, P.C.

(57) ABSTRACT

A soleplate unit of electric iron with improved front structure, comprising: a shallow groove provided on the bottom surface of the front side of the soleplate unit, a sheet set in said shallow groove and the front of the sheet extending outwardly from the front side of the soleplate unit. A high rigid surface layer is provided on the surface of the sheet, or the sheet is made of high rigid material. The sheet is tongue in shape, and two front sides of the sheet extend outwardly from the front side of the soleplate unit. The soleplate unit can also be provided with a sheet that extends outwardly from the front of the soleplate unit. It is very convenient for users to iron the face fabric near the button and the slide fastener.

6 Claims, 5 Drawing Sheets

SOLEPLATE UNIT OF ELECTRIC IRON

TECHNOLOGY FIELD

The present utility model relates to components of electric iron, especially to the soleplate unit of electric iron with improved front structure.

BACKGROUND OF THE INVENTION

The soleplate unit of existing electric iron is thick so that the tubular electric heating element can be installed in the said soleplate unit. The front of soleplate unit is designed to be a wedge-shaped triangle, but it is hard to iron the face fabric near the button and the slide fastener.

SUMMARY OF THE INVENTION

The present utility model is to provide a soleplate unit of electric iron convenient for ironing the face fabric near the button and the slide fastener.

The present utility model adopts the following technical solution:

The soleplate unit of electric iron comprises: a shallow groove provided on the bottom surface of the front side of said soleplate unit, a sheet set in said shallow groove and the front side of said sheet extending outwardly from the front side of said soleplate unit.

In the preferred embodiment based on present utility model, a high rigid surface layer is provided on the surface of said sheet, or said sheet is made of high rigid material. The abrasion resistance of said soleplate unit is improved by enhancing the rigidity of surface of said sheet.

Especially the shape of said sheet is tongue-shaped, and the two front sides extend outwardly from the front side of said soleplate unit, it is very convenient for ironing the face fabric near the button and the slide fastener.

The present utility model adopts another technical solution:

A soleplate unit of electric iron comprises: a sheet extending outwardly from the front side of said soleplate unit of electric iron.

In the preferred embodiment based on present utility model, said sheet is V-shaped, and the two sides extend outwardly from the front side of said soleplate unit, it is very convenient for ironing the face fabric near the button and the slide fastener.

The soleplate unit of electric iron based on the present utility model, a shallow groove is provided in the bottom surface of the front of said soleplate unit, a sheet is set in said shallow groove; the front of said sheet extends outwardly from the front of said soleplate unit. Because the front of said sheet is very thin, it is very convenient for ironing the face fabric near the button and the slide fastener. A high rigid surface layer is provided on the surface of said sheet, or said sheet is made of high rigid material. The abrasion resistance of said soleplate unit is improved by enhancing the rigidity of surface of said sheet, for saving the cost of the soleplate unit. A sheet extends outwardly from the front of said soleplate unit of electric iron, because said sheet is very thin, it is very convenient for users to iron the face fabric near the button and the slide fastener.

DETAILED DESCRIPTION OF THE PREFERRED EMBODIMENTS

Embodiment 1

Figure 1:
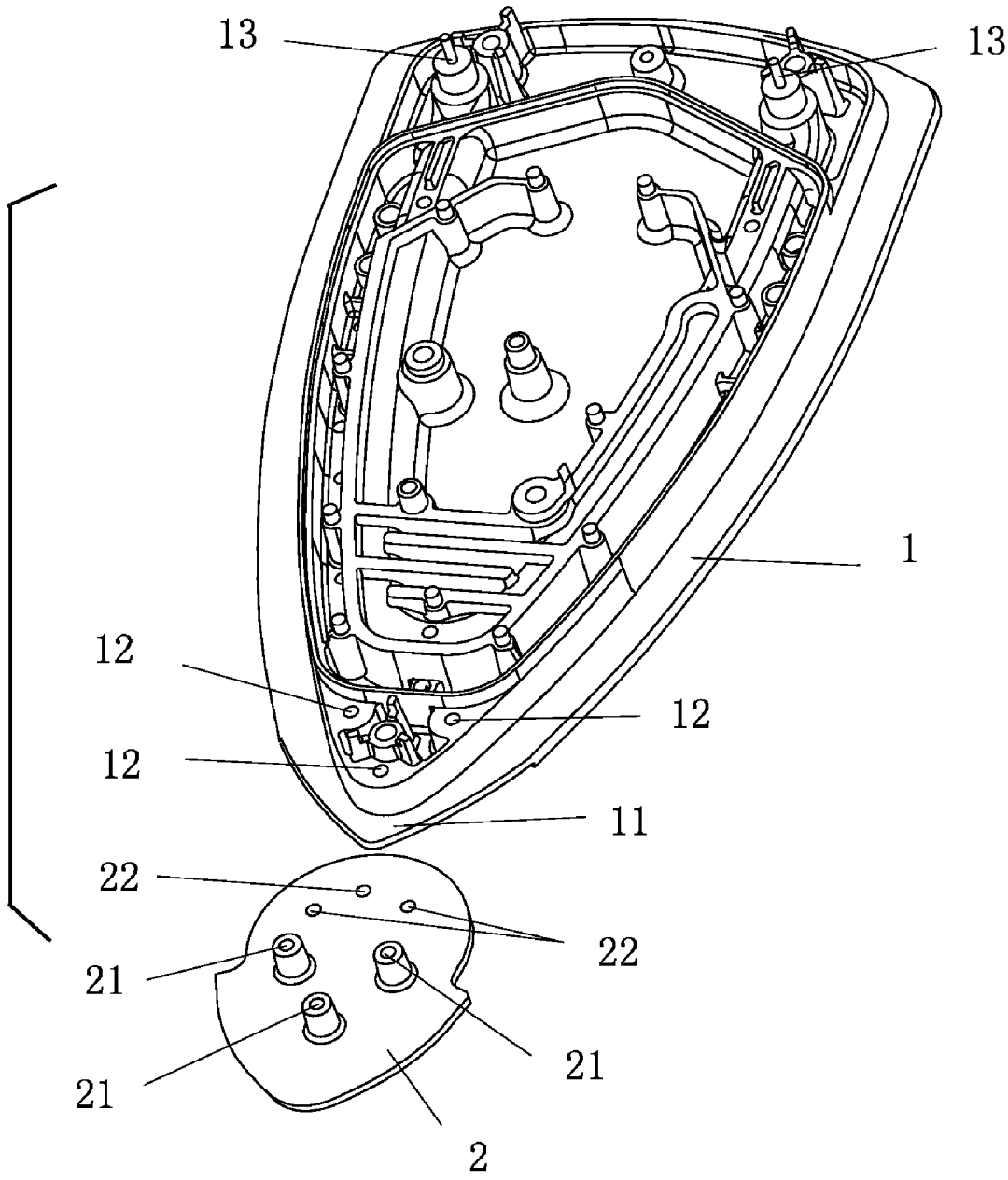
FIG. 1 is an exploded perspective view of one embodiment of the soleplate unit of electric iron based on the present utility model.

Referring to FIG. 1, it is the structure of a soleplate unit of a preferred embodiment based on present utility model. A shallow groove is provided on the bottom surface of the front side 11 of a soleplate 1, a sheet 2, which can be known as a decorative plate, is set in said shallow groove.

Three ⊓-shaped (stepped) holes 12 and three screw holes are provided in the front side 11 of said soleplate 1, said front side 11 is above said shallow groove. The tubular electric heating element is installed in the said soleplate 1, two electrodes 13 of said tubular electric heating element are introduced upwardly from the rear of said soleplate 1.

The shape of said sheet 2 is tongue-shaped, a high rigid surface layer is provided on the surface of said sheet 2 by Anodizing or other process, or said sheet 2 is made of high rigid material. Three short rods 21 having screw hole, which are corresponding to the three ⊓ -shaped holes of the soleplate 1, are set on the top surface of the middle of said sheet 2. The holes 22, which are corresponding to the three screw holes, are set on the rear portion of said sheet 2.

Figure 2:
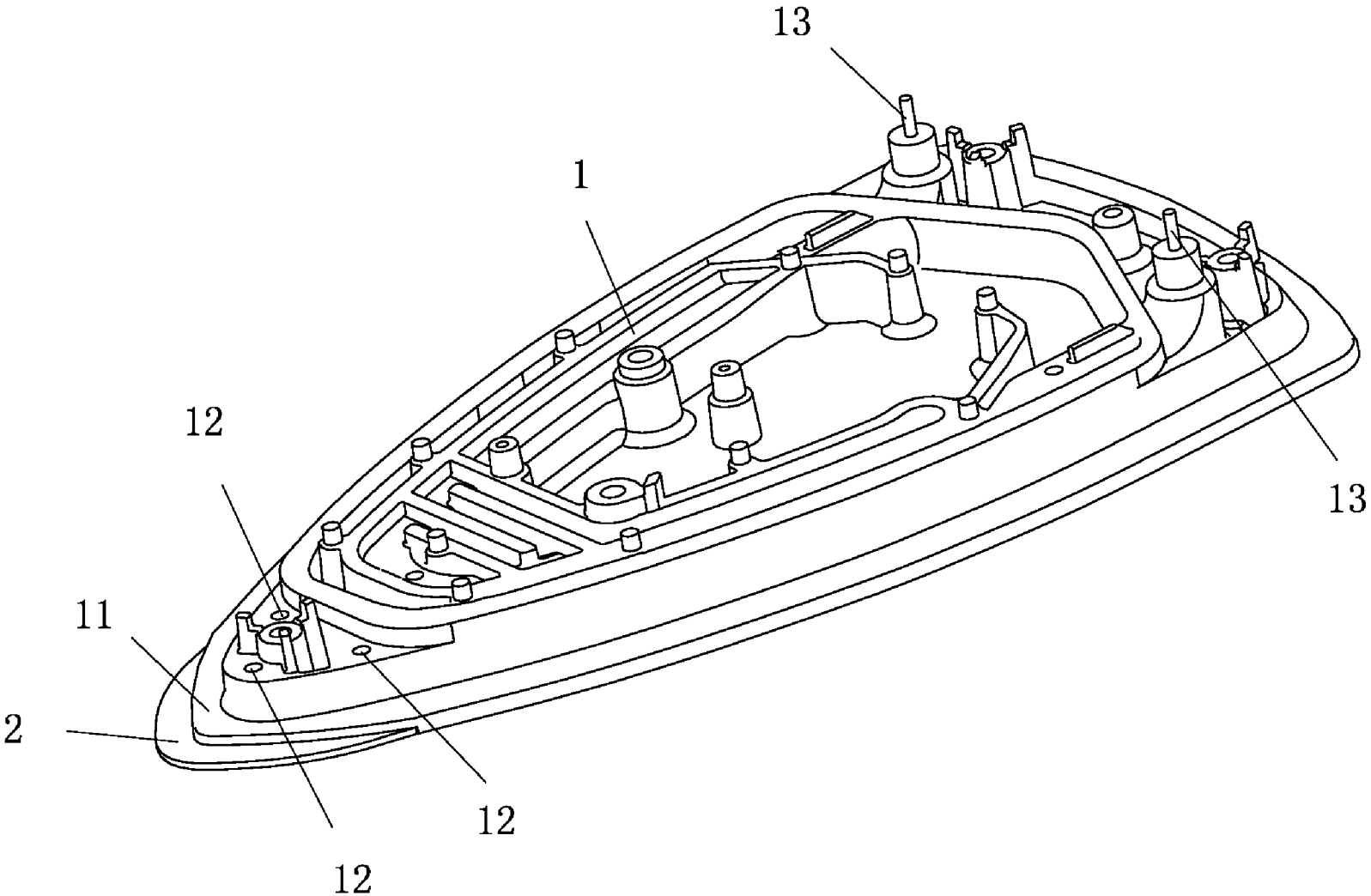
FIG. 2 is a perspective view of the embodiment in FIG. 1.

When assembled, said sheet 2 is positioned in the shallow groove of the front side 11, the three short rods 21 on said sheet 2 are inserted into the corresponding ⊓-shaped holes 12, screws are also inserted into the ⊓ -shaped holes 12 and the screw holes of the short rods 21, and the sheet 2 is immovably fixed on the front side 11 of the soleplate 1, with an apex of the sheet being in alignment with an apex of the soleplate, and forming a step therewith. Referring to FIG. 2, two front sides of the front side of said sheet 2 extend outwardly from the triangle front side 11 of the soleplate 1, it is very convenient for ironing the face fabric near the button and the slide fastener.

Figure 3:
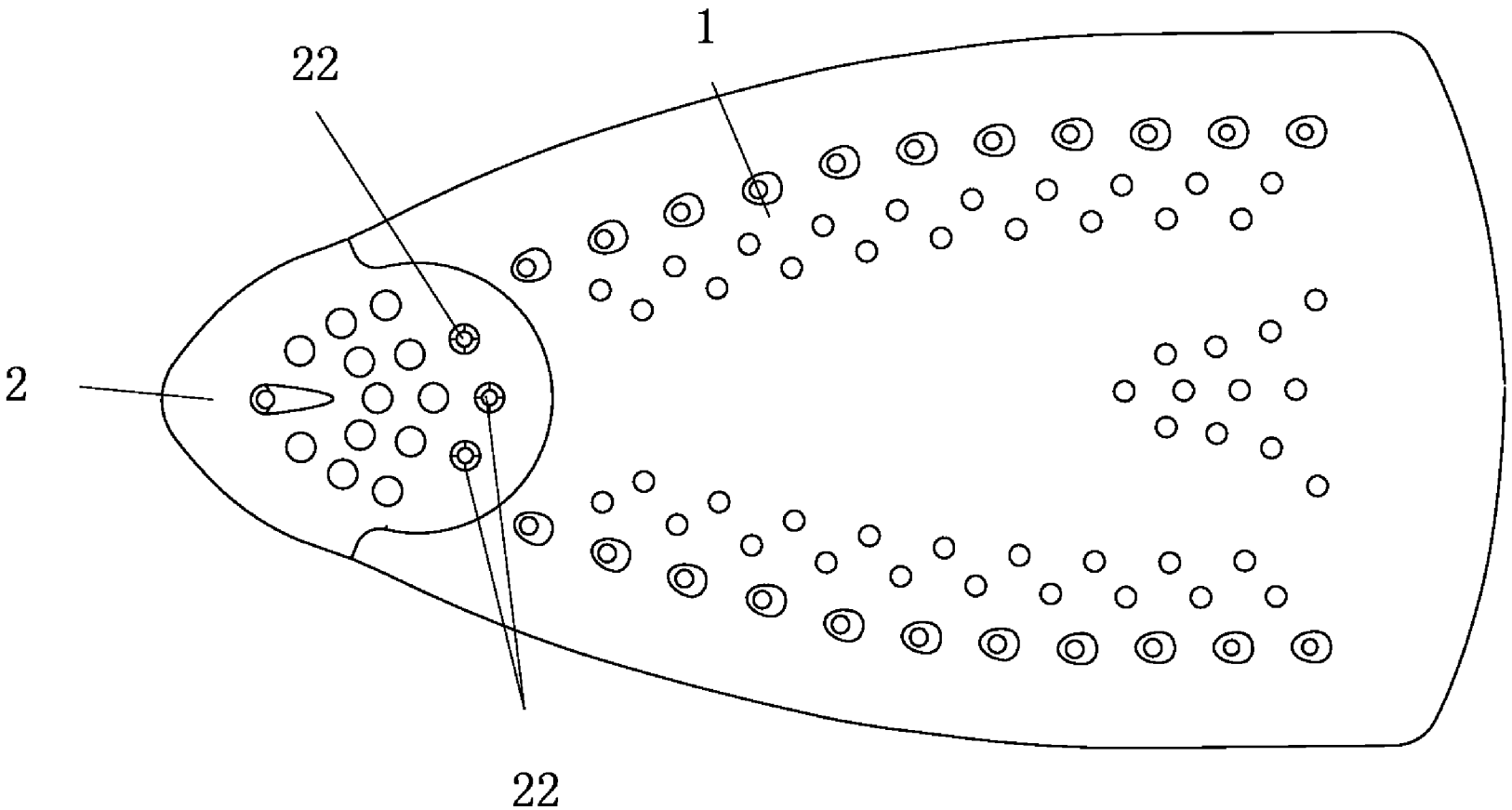
FIG. 3 is a bottom view of the embodiment in FIG. 1.

Referring to FIG. 3, three screws go through the holes 22 and fix in the screw holes via thread tightening, the rear of said sheet 2 is fixed on the front side of the soleplate 1, the bottom surface of said sheet 2 and the bottom surface of said soleplate 1 are on same level.

Since the sheet 2 formed on the front side 11 of soleplate 1 of the present embodiment is thin, it is very convenient for users to iron the face fabric near the button and the slide fastener, and achieve satisfactory results.

Embodiment 2

Figure 4:
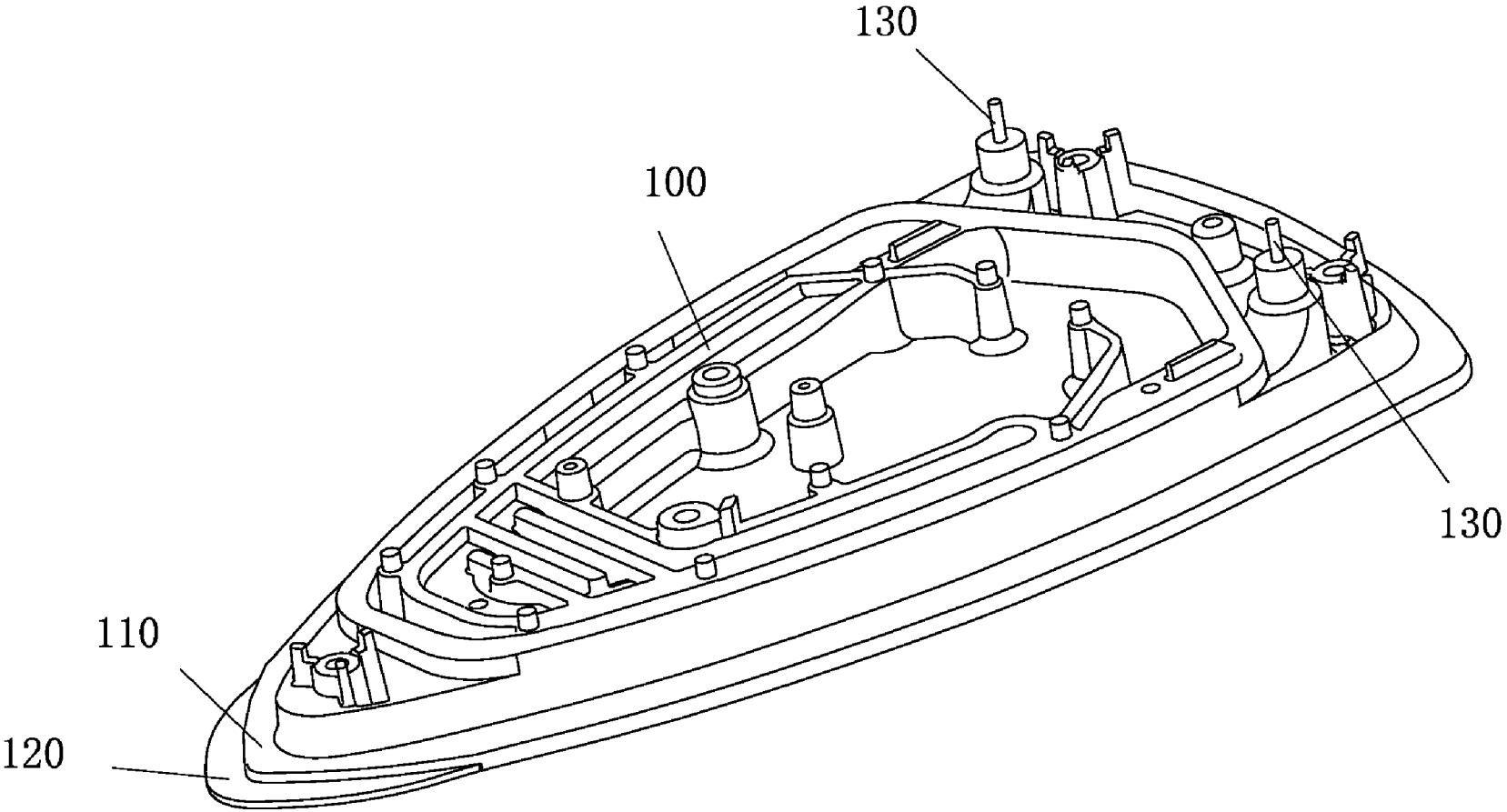
FIG. 4 is a perspective view of another embodiment of the soleplate unit of electric iron based on the present utility model.

Referring to FIG. 4, it is a structure of simplified embodiment based on the present utility model, a V-shaped sheet 120 extends outwardly from the front side 110 of said soleplate 100. Two sides of said sheet 120 extend outwardly from the triangle front side 110 of the soleplate 100. The tubular electric heating element is installed in the said soleplate 100, two electrodes 130 of said tubular electric heating element are introduced upwardly from the rear of said soleplate 100.

Figure 5:
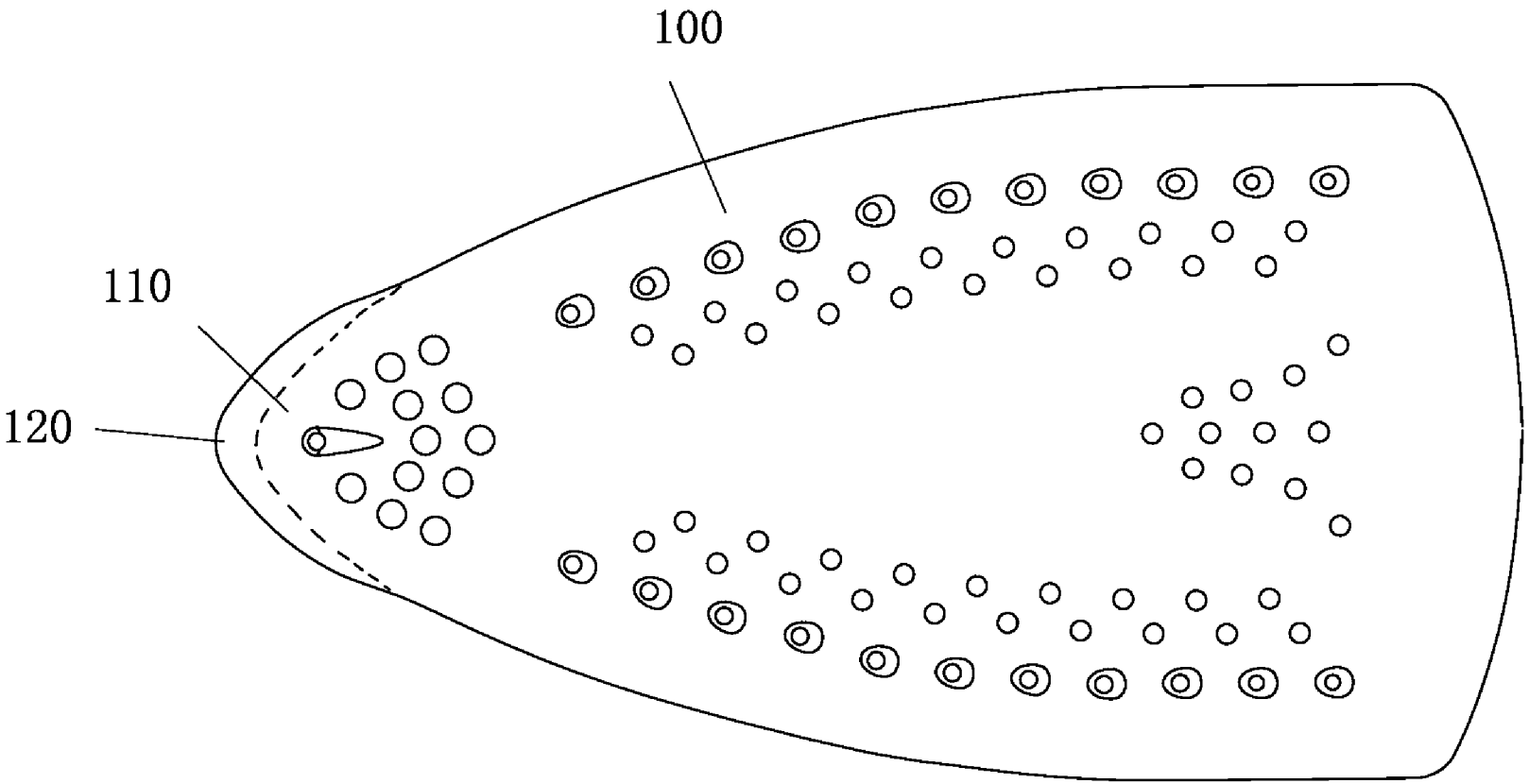
FIG. 5 is a bottom view of the embodiment in FIG. 4.

Referring to FIG. 5, since the sheet 120 extends outwardly from the bottom surface of said soleplate 100, and the bottom surface of said sheet 120 and the bottom surface of said soleplate 100 are on same level.

Since the sheet 120 formed on the front side 110 of soleplate 100 of the present embodiment is thin, it is very convenient for users to iron the face fabric near the button and the slide fastener, and achieve satisfactory results.

It will be understood that the description above is of the preferred exemplary embodiment of the invention and that the invention is not limited to the specific forms shown and described. Other substitutions, modifications, changes and omissions may be made in the design and arrangement of the preferred embodiment without departing from the spirit of the invention as expressed in the appended claims.

What is claimed is:

1. A soleplate unit of an electric iron, comprising:

a sole plate having a shallow groove provided on a bottom surface of a front side of said soleplate, a sheet set in said shallow groove, a front side of said sheet extending outwardly from the front side of said soleplate, said sheet being immovably fixed to said sole plate, and extending past an apex of said soleplate.

2. The soleplate unit of an electric iron according to claim 1, wherein a high rigid surface layer is provided on a surface of said sheet.

3. The soleplate unit of an electric iron according to claim 1, wherein said sheet is tongue-shaped and has two front sides that extend outwardly from the front side and on respective opposing sides of the apex of said soleplate.

4. The soleplate unit of an electric iron according to claim 1, wherein said sheet is V-shaped and has two sides that extend outwardly from the front side and on respective opposing sides of the apex of said soleplate.

5. The soleplate unit of an electric iron according to claim 1, wherein said sheet is made of a high rigid material.

6. The soleplate unit of an electric iron according to claim 1, wherein an apex of the sheet is disposed in alignment with the apex of said soleplate, with a step being formed between the apex of the soleplate and the apex of the sheet.

* * * * *